United States Patent [19]

Jahn

[11] Patent Number: 5,002,007

[45] Date of Patent: Mar. 26, 1991

[54] LAQUERING DEVICE IN ROTARY PRINTING PRESSES

[75] Inventor: Hans-Georg Jahn, Wiesenbach, Fed. Rep. of Germany

[73] Assignee: Heidelberger Druckmaschinen AG, Heidelberg, Fed. Rep. of Germany

[21] Appl. No.: 223,688

[22] Filed: Jul. 22, 1988

Related U.S. Application Data

[63] Continuation of Ser. No. 850,247, Apr. 10, 1986, abandoned.

[30] Foreign Application Priority Data

Apr. 13, 1985 [DE] Fed. Rep. of Germany ..... 3513291

[51] Int. Cl.[5] ..... B05C 1/02; B41F 23/00

[52] U.S. Cl. ..... 118/46; 118/249; 101/141

[58] Field of Search ..... 101/153, 416 B, 416 R, 101/141; 118/46, 249

[56] References Cited

U.S. PATENT DOCUMENTS 4,308,796 1/1982 Satterwhite ..... 101/143

4,393,773 7/1983 Theilacker ..... 101/232

FOREIGN PATENT DOCUMENTS

3324096A1 1/1985 Fed. Rep. of Germany .

2132559 7/1984 United Kingdom ..... 101/177

*Primary Examiner*—Clifford D. Crowder

*Attorney, Agent, or Firm*—Herbert L. Lerner; Laurence A. Greenberg

[57] ABSTRACT

In a sheet rotary printing press having printing units followed by a delivery, a lacquering device located downstream of the printing units and upstream of the delivery and including a lacquer application cylinder for transferring lacquer onto a printed sheet lying on an impression cylinder, a metering roller operatively associated with the lacquer application cylinder, and a dipping roller operatively associated with the metering roller and immersed in a supply of lacquer received in a tank, the metering roller transferring a defined layer of lacquer to the lacquer applicator cylinder and having a diameter comparable to the diameter of the lacquer applicator cylinder in accordance with a ratio of 0.6:1 to 1:1.

1 Claim, 1 Drawing Sheet

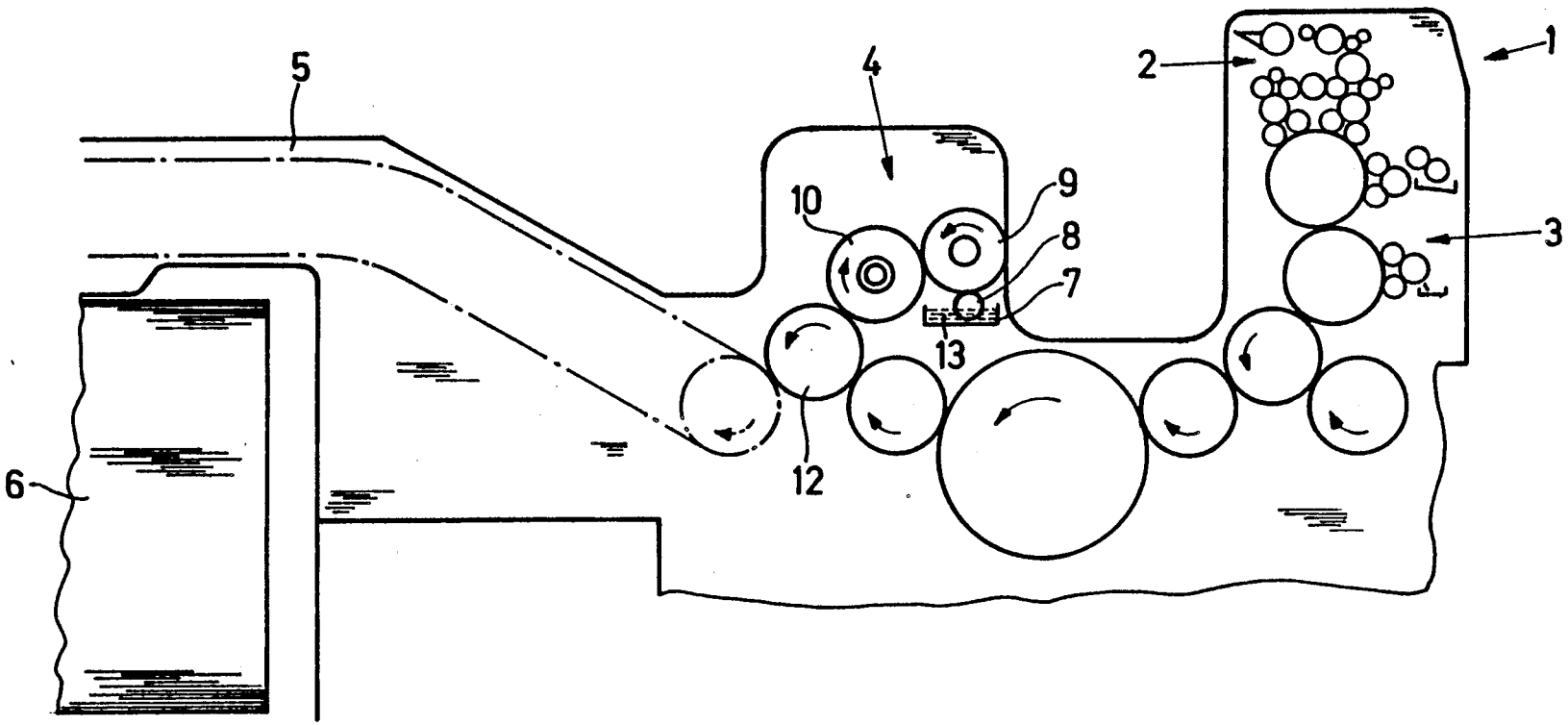
1
2
3
4
5
6
7
8
9
10
12
13

LAQUERING DEVICE IN ROTARY PRINTING PRESSES

This application is a continuation of application Ser. No. 850,247, filed Apr. 10, 1986, now abandoned.

The invention relates to a lacquering device in rotary printing presses.

Heretofore known devices of this general type are located downstream of the printing units of a printing press as so-called lacquering units and are used to coat the fresh print with a layer of lacquer to protect it from damage in use. It is desirable to apply as thick a coat of lacquer as possible to certain printed material so as to produce a surface thereon which is markedly resistant to abrasion and has a high gloss. It has been shown that, in practice, when transferring a thick lacquer film, a danger exists at the limits of the lacquered surface, that the lacquer layer will pick up. These lacquer edges do not dry in the time available, so that the lacquered sheets stick together in the delivery pile and thus cannot be used. In such cases, the thickness of the lacquer coating has to be reduced.

Heretofore known lacquering units of this general type, such as the unit described in German Published, Non-Prosecuted Application (DE-OS) 3324096, make use of lacquering unit rollers with small diameters so that they are more quickly cleaned and easier to remove from the machine e.g. in order to exchange them.

It has been shown, with such lacquering units, that there is a limit to the quantity of lacquer which can be transferred, so that it is not possible to fulfill the wishes of the printer's customers.

Starting from this state of the art, it is an object of the invention to provide a lacquering unit which is able to transfer relatively thick coatings of lacquer without any lifting of the lacquer at the ends of the lacquered surface and without producing lacquer edges on the printed products.

With the foregoing and other objects in view, there is provided, in accordance with the invention, a sheet rotary printing press having printing units followed by a delivery, a lacquering device located downstream of the printing units and upstream of the delivery and comprising lacquer applicator cylinder for transferring lacquer onto a printed sheet lying on an impression cylinder, a metering roller operatively associated with the lacquer applicator cylinder, and a dipping roller operatively associated with the metering roller and immersed in a supply of lacquer received in a tank, the metering roller transferring a defined layer of lacquer to the lacquer applicator cylinder and having a diameter comparable to the diameter of the lacquer applicator cylinder in accordance with a ratio of 0.6:1 to 1:1.

Due to the relatively large diameter of the rollers which transfer the lacquer coating to the lacquer applicator cylinder, there remains considerably more time for the lacquer separation process in the roller gap or nip than is the case with roller diameters which differ greatly from one another. A consequence of this is that the coats of lacquer are able to separate more evenly from one another, enabling a thicker coating of lacquer to be transferred without any lifted edge being formed and thus producing a high gloss finish on the printed product.

Other features which are considered as characteristic for the invention are set forth in the appended claims.

Although the invention is illustrated and described herein as embodied in a lacquering device in rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing which is a fragmentary, diagrammatic elevational view of a printing press with a lacquering unit according to the invention.

Referring now to the drawing, there is shown a lacquering unit 4 located downstream of the last printing unit 1 of a printing press with a conventional type of inking unit 2 and dampening unit 3. In this case, the printed sheets are fed from the last printing unit 1 to the lacquering unit 4 via a number of transfer drums. Downstream of the lacquering unit 4, the lacquered sheets are transported by a delivery chain 5 to a delivery pile 6.

The lacquering unit 4 is formed of a rotating dipping roller 8 which is immersed in a tank 7, a metering roller 9 and a lacquer applicator cylinder 10 provided with a rubber coated surface. The lacquer applicator cylinder 10, which has the same diameter as the impression cylinder 12 of the respective printing unit, can also be covered with a separate rubber blanket in the conventional manner. This so-called lacquer blanket can have as an underlay a format sheet defining the surface area to be coated with lacquer. The sheets are fed in a conventional manner also over the impression cylinder 12 by means of gripper rows which are arranged with clamping devices for the rubber blanket in the channel formed in the cylinder 12.

A supply of lacquer for coating the freshly printed sheets is received in the tank 7. A specific quantity of the lacquer is transferred by the dipping roller 8 to the metering roller 9, which has a diameter ratio relative to the lacquer applicator cylinder 10 of 0.6:1 to 1:1. The large diameter of the metering roller 9, which can correspond with the diameter of the lacquer applicator cylinder 10, results in a uniform coating of lacquer between both roller 9 and cylinder 10 so that no lacquer edges or runs are produced even when applying fairly large quantities of lacquer.

The foregoing is a description corresponding in substance to German Application P 35 13 291, dated Apr. 13, 1985, the International priority of which is being claimed for the instant application, and which is hereby made part of this application. Any material discrepancies between the foregoing specification and the aforementioned corresponding German application are to be resolved in favor of the latter.

What is claimed is:

1. In a sheet-fed rotary printing press having printing units followed by a delivery, a lacquering device located downstream of the printing units and upstream of the delivery and comprising a lacquer applicator cylinder for transferring lacquer onto a printed sheet lying on an impression cylinder, a metering roller operatively associated with said lacquer applicator cylinder, and a dipping roller operatively associated with said metering roller and immersed in a supply of lacquer received in a tank, said metering roller transferring a defined layer of lacquer to said lacquer applicator cylinder and having a diameter of from 0.6:1 to 1:1 with respect to the diameter of said lacquer applicator cylinder.

* * * * *